United States Patent [19]

Gluntz

[11] Patent Number: 4,847,043

[45] Date of Patent: Jul. 11, 1989

[54] STEAM-ASSISTED JET PUMP

[75] Inventor: Douglas M. Gluntz, San Jose, Calif.

[73] Assignee: General Electric Company, San Jose, Calif.

[21] Appl. No.: 147,386

[22] Filed: Jan. 25, 1988

[51] Int. Cl.[4] ..... G21C 15/24

[52] U.S. Cl. ..... 376/372; 417/197

[58] Field of Search ..... 376/372, 392, 407; 417/197, 179

[56] References Cited

U.S. PATENT DOCUMENTS

| | | | |
|---|---|---|---|
| 3,607,635 | 9/1971 | Ripley et al. | 376/372 |
| 3,621,926 | 11/1971 | Townsend | 376/372 |
| 3,625,820 | 12/1971 | Gluntz et al. | 376/372 |
| 4,212,594 | 7/1980 | Sheer, Jr. | 376/407 |
| 4,280,796 | 7/1981 | Reinsch | 376/298 |
| 4,440,719 | 4/1984 | Howard | 376/372 |
| 4,569,635 | 2/1986 | Nicodemus | 417/197 |
| 4,580,948 | 4/1986 | Schmidlin | 417/197 |

FOREIGN PATENT DOCUMENTS

| | | | |
|---|---|---|---|
| 0155391 | 12/1979 | Japan | 376/372 |

*Primary Examiner*—Brooks H. Hunt

*Assistant Examiner*—Daniel Wasil

*Attorney, Agent, or Firm*—Robert R. Schroeder

[57] ABSTRACT

An improved liquid jet pump for water is described in which the water issuing from the jet pump drive nozzle passes into a nozzle mixing chamber where steam is introduced to nozzle outflow. This steam, traveling in the same direction as and converging upon the liquid driving stream, is raised to high velocities. These uncommonly high velocities of steam are attained both as a result of passage through a converging/diverging nozzle and the action of condensation upon the passing liquid stream. The liquid driving stream is supplied at a temperature which promotes immediate condensation of the steam molecules of the high speed steam jet. A process of momentum exchange immediately occurs within the drive nozzle mixing chamber between the high-velocity steam and the parallel-moving slower liquid stream with momentum being transferred from the steam to the liquid driving stream. The liquid driving stream with its enhanced momentum is thereafter exhausted from the nozzle mixing chamber and used conventionally to drive the jet pump. Improved jet pump recirculation system is described for use with current and advanced boiling water nuclear reactors.

4 Claims, 5 Drawing Sheets

STEAM-ASSISTED JET PUMP

The disclosure relates to jet pumps that move liquid from a low (suction) pressure to a high (discharge) pressure. More specifically, the invention discloses a liquid jet pump implemented in velocity and total momentum by a condensing jet of high velocity steam utilizable to assist jet pumping.

BACKGROUND OF THE INVENTION

Conventional jet pumps include a body having three distinct regions. These regions are a converging inlet section, a mixer section of substantially uniform cross-sectional area throughout its length, and a diffuser section which diverges or increases in cross-sectional area in the flow direction. If desired, a short tailpipe having a uniform cross-sectional area equal to the cross-sectional area of the diffuser exit may be included on the end of the diffuser.

A jet pump is typically powered by a jet of fluid. A nozzle is positioned in the inlet section to convert a high-pressure stream of driving fluid into a high-velocity, low-pressure jet of driving fluid. This high velocity, low pressure jet of driving fluid flows axially through the inlet section of the jet pump and into the mixing section of the jet pump.

In virtually all jet pump applications, fluid termed as "drive fluid" is pumped to the region of the jet pump nozzle. This pumping occurs via piping of a size generally optimized to balance the captial costs of the piping against the operating costs of the pumping energy.

The flow passage of the driving fluid stream begins with the generally-always-larger cross-sectional area drive fluid supply piping, sized to mitigate fluid flow loss. At the nozzle this flow passage then gradually reduced, allowing drive flow that is initially at high pressure to accelerate smoothly until it attains the static pressure corresponding to the nozzle exit.

The drive nozzle may be comprised of a single jet or may be represented as a plurality of jets. When a single jet is used, the nozzle is positioned to discharge the jet in a downstream direction along the longitudinal axis of the jet pump body. When the drive flow is subdivided into multiple jets, these jets are usually positioned equally spaced to some radius between the jet pump body longidutinal axis and the inside diameter of the mixing section and are oriented to discharge coaxially.

The high-velocity jet or jets entrains fluid surrounding the nozzle in the inlet section as well as in the entrance region of the mixer section by conventional driving stream to driven stream momentum transfer. This momentum transfer continuously induces the surrounding or "driven" fluid to flow into and through the inlet section.

The velocity of the entrained driven fluid increases due to the decreasing cross-sectional flow area as the driven fluid moves through the converging inlet. Thus, the pressure of the combined driving and driven fluids are reduced to a low value.

The converging inlet section surrounding the nozzle directs the driven fluid into the mixing section. Within the mixing section, the high-velocity jet of driving fluid gradually widens as an entrainment-mixing process takes place with the driven fluid. During mixing, momentum is transferred from the high-velocity driving stream to the driven fluid, so pressure of the combined stream increases.

The mixing process ends in the mixer. This end occurs, in theory, after the velocity taken across an area perpendicular to the longitudinal axis of the mixer becomes nearly constant (except in the boundary layer close to the walls). When this velocity profile occurs, it is said that a nearly "flat" velocity profile has been attained. Generally, it is assumed that this flat profile occurs shortly after the jet expands to touch the walls of the mixing section.

From the mixing section, the mixed driving and driven fluids flow into a diffuser of increasing cross-sectional area in the flow direction. This diffuser has two functions.

First, it further increase inlet section to diffuser exit pump discharge pressure.

Second, the velocity of the mixed fluids exhausting from the jet pump is reduced.

Thus, a jet pump operates on the principle of the conversion of momentum to pressure. The driving fluid issuing from the nozzle has low pressure, but high velocity and momentum. By a process of momentum exchange, driven fluid from the inlet or suction section is entrained and the combined flow enters the mixing section. In the mixing section, the velocity profile, i.e., a curve showing fluid velocity as a function of distance from the longitudinal axis of the mixing section, is changed by mixing. Momentum decreases and the velocity profile becomes nearly flat, i.e., perpendicular to the longitudinal axis of the mixing chamber.

The decrease in momentum results in an increase in fluid pressure. The flat velocity profile gives minimum momentum with a resulting highest pressure increase in the mixing section. In the outwardly diverging diffuser, the relatively high velocity of the combined stream is smoothly reduced and converted to a still higher pressure.

When the term "jet pump" is used, convention implies that both suction fluid and drive fluid are in the same fluid states. The fluid states can be liquid state, or the gaseous state. When the application involves the gaseous state, convention in the continued use of the term "jet pump" implies that compressible effects are not significant in the design. Otherwise, such terms as "ejectors", "injectors", "educators", "pressure amplifiers" and the like are used to more clearly describe the application and the device characteristics.

Jet pumps are useful in many systems. Often, such system applications involve pumping large quantities of fluid at high rates. Thus, small improvements in pump performance can have major effect on system performance and economy.

One application for which liquid jet pumps are especially suited is the recirculation of coolant in a nuclear reactor of the boiling water reactor (BWR) type. In a typical large boiling water reactor about 270,000 gallons/minute of coolant is recirculated by jet pumps. Thus, it is apparent that small increases in jet pump efficiency will produce important improvements in system performance and economy.

It is desirable in certain BWRs to accomplish the nuclear reactor coolant recirculation process by forced-circulation, as opposed to natural circulation, to gain an overall more compact reactor pressure vessel with concomitant savings in nuclear steam supply system costs and containment costs. One such forced-circulation system is employed in the General Electric Company BWR/3 through BWR/6 product line of forced-circulation reactors. This system uses jet pumps mounted inside the reactor vessel.

The motive flow driving the jet pump is supplied by external mechanical (centrifugal) pumps. These external recirculation pumps take suction from the downward flow in the annulus between the core shroud and the reactor vessel wall.

This downward flow consists of feedwater mixed together with separated liquid that has been separated out from the two-phase mixture produced by the nuclear reactor core. The separated liquid is produced at the steam separator and steam dryer drains and is recirculated back to the entrance to the core. The feedwater represents coolant inventory returning to the reactor. This returning coolant inventory balances the reactor-produced steam which is supplied to the power station turbine.

In order to drive the motive flow, approximately one third of the downcomer recirculation flow is taken from the vessel through two recirculation nozzles. Thereafter, it is pumped to higher pressure, distributed in a manifold to which a number of riser pipes are connected, and returned to the vessel via inlet nozzles. Inside the reactor, piping connects from each of these inlet nozzles to one or more jet pumps.

In the jet pump this now-high-pressure flow is discharged in the jet pump nozzle, inducing the remainder of the downcomer flow. In the jet pump, the flows mix (producing exchange, and unification of momentum), diffuse (an action which converts momentum into higher pressure), and discharge into the core lower plenum. Forced circulation of the entire reactor coolant results.

One of the disadvantages of the above jet pump recirculation system is that jet pumps have characteristically poorer mechanical efficiency than do centrifugal pumps. Consequently, the electrical power (assuming motor-driven centrifugal pumps) required to drive the entire recirculation flow is greater than that for non-jet-pump recirculation systems. Those familiar with boiling water reactor design will appreciate that a non-jet-pump system often entails many other, much more costly disadvantages. Hence, the non-jet-pump system is not necessarily the indisputably preferred modern BWR recirculation system.

Certain improved BWR recirculation systems seek to eliminate the external recirculation loops associated with existing jet-pump-type BWRs. This saves capital equipment costs, enables compacting the reactor containment, and reduces the personnel radiation exposure that occurs during maintenance servicing on the drive pumps and during inservice inspections of the coolant piping weld integrity.

Among the several practical means of eliminating these external loops, one such conceptual means long under design study is to use feedwater-driven jet pumps (FWDJPs). In the FWDJP recirculation system design concept, a substantial portion—such as 80%—of the feedwater is raised to extra-high pressures—such as 2700 psig—by mechanical pumps in the feedwater train. This high-pressure feedwater is piped to the nozzles of jet pumps mounted as before in the reactor downcomer annulus. The high-pressure feedwater is accelerated in the convergent-flow-area FWDJP nozzle to high velocities and discharged at the jet pump nozzle. This induces the balance of the recirculation flow—which now consists of the mixture of liquid returning from the steam separators plus the residual (20%) portion of the feedwater—to be pumped through the FWDJP and discharged at requisite higher pressure into the core lower (entrance) plenum.

One of the disadvantages remaining with the FWDJP recirculation system described above, is that the resulting FWDJP must operate with a high proportion of induced flow per unit of drive flow. (The ratio of induced flow/drive flow is termed the "M-ratio"). A performance disadvantage with jet pumps is that when M-ratios exceed 1.5, approximately, the jet pump efficiency becomes increasingly poorer. The application described in the paragraph above produces an M-ratio of about 8.6. The FWDJP efficiency is substantially diminised below the best-possible-efficiency at which jet pumps—given lower M-ratios—are capable of operating.

Yet another disadvantage of the FWDJP recirculation system described above is that an extra mechanical pump(s) is required (if total feedwater pumping power is to be minimized) in the feedwater train(s) to boost the FWDJP drive flow beyond the 1250 psig pressure (at conventional BWR feedwater pump discharge) to the 2700 psig needed to accomplish FWDJP recirculation.

Yet another disadvantage is that piping design pressures (and thus pipe wall thicknesses and thus piping costs) are raised in the feedwater delivery piping running between feedwater pump discharge into the reactor.

SUMMARY OF THE INVENTION

This invention provides an improved steam-assisted liquid jet pump in which the high potential energy represented by steam is used, in nozzle mixing section located upstream of the jet pump body, to accelerate the jet pump liquid drive system. The steam, at a pressure exceeding the saturated pressure corresponding to the bulk temperature of the liquid drive stream, is expanded through a converging/diverging nozzle—down to the saturation pressure. This expansion results in conversion of steam pressure to steam velocity. In a preferred configuration, the steam nozzle accomplishing the steam expansion is configured to surround a central jet of drive liquid which itself has been accelerated, via its own nozzle, from supply pressure down to saturated pressure. The steam, travelling with higher velocity than the liquid, simultaneously mixes and condenses as the two flows proceed downstream in a nozzle mixing section that continuously converges. This process of mixing and condensing also produces momentum exchange between the two steam and water streams. The converging nozzle mixing section ends at a point just downstream of the point where nominally complete condensation has occurred. The higher momentum of the jet of fluid emerging from this nozzle mixing section is manifested as a higher velocity than can be obtained without the action of the steam. The total jet momentum emerging from the nozzle mixing section of the steam-assisted jet pump is yet-higher because of the mass addition represented by the condensed steam. This emergent jet flow is, in turn, positioned in the suction inlet of the main jet pump body so that it discharges analogous to the the positioning of the discharging drive fluid from a conventional jet pump. Because this emergent stream in the steam-assisted jet pump has greater momentum than is available to a conventional jet pump having same drive stream supply pressure and flow rate, this steam-assisted jet pump possesses correspondingly improved capabilities to induce suction fluid through the jet pump body.

In an alternate configuration, the steam may be presented to the nozzle-mixing-section so that it discharges downstream centrally at the longitudinal axis, with the colder drivewater surrounding this jet of expanded, high-velocity steam.

In either case, this steam-assisted jet pump, individually optimally designed for each of the nuclear reactor recirculation flow applications described above, will require less electrical energy per unit of net recirculation flow than for their corresponding standard BWR/3-BWR/6 applications or the FWDJP applications currently devised. This improved jet pump will improve the effective system pumping efficiency as measured by comparative net plant heat rates. Furthermore, in the case of the FWDJP application, this steam-assisted jet pump can result in eliminating the need for a special feedpump to boost pressure from 1250 psig to 2700 psig. Because the device internals in this latter case fit totally inside the reactor, there is no extra-high-pressure external piping required. Finally, because the steam adds to the mass flow rate discharged from the nozzle of the steam-assisted FWDJP, to perform a fixed amount of recirculation flow the M-ratio of the FWDJP can be reduced, thus enabling its operating point to be at a more favorable, higher, efficiency.

OTHER OBJECTS, FEATURES AND ADVANTAGES

An object of this invention is to disclose an apparatus and a process for increasing the velocity of a jet pump's liquid driving stream with an inflow of steam. Accordingly, the jet pump is provided with a nozzle mixing section. The nozzle mixing section includes at its inlet end a water inlet nozzle and a steam inlet nozzle—the steam inlet nozzle preferably surrounding the water jet and exhausting in the same direction. The steam jet is produced by the presence of a pressure differential existing across the steam nozzle.

The steam passes through a converging and diverging shaped passage (nozzle) where the steam flow experiences a decrease in pressure and conversion to high velocity. In the central region of the nozzle mixing section, steam comes into contact with the liquid stream. This produces steam condensation, which maintains the pressure differential across the steam nozzle. Momentum transfer occurs from the high velocity steam to the slower water stream. There ultimately issues from the nozzles of the nozzle mixing section a steam-accelerated fluid stream. This steam-accelerated fluid stream emerges from the nozzle mixing section as a fluid jet containing significantly enhanced momentum. This momentum-enhanced jet has the capability of providing improved jet pumping by the jet pump.

A further object of this invention is to disclose the use of such a steam-assisted jet pump in combination with a nuclear reactor, such as a nuclear boiling water reactor. According to this aspect, a plurality of steam-assisted jet pumps forcing circulation within the nuclear reactor are each powered by a stream of drivewater, the drivewater being well below the saturation temperature of the discharged saturated steam from the reactor. Each of these steam-assisted jet pumps is provided with a nozzle mixing section as previously disclosed. Steam is mixed with the drivewater in the nozzle mixing section of the reactor jet pumps. Thereafter, the combined, condensed and accelerated fluid stream is utilized to drive the jet pumps effecting forced circulation in the reactor.

An advantage of this aspect of the invention is that the steam-assisted jet pump extracts a lesser energy penalty from the nuclear power station than conventional water driven jet pumps now realize.

A further additional advantage is that the improved jet pump by producing acceleration of the fluid stream at the mixing section within the nozzle can reduce the drivewater pump head supplied to the jet pump. In other words, the velocity added by the steam jet immediate the nozzle of the jet pump obviates the requirement that a drivewater pump—such as a feedwater pump—remote from the jet pump be used to supply additional head. Consequently the inefficiencies associated with remote pumps and their piping losses are reduced.

A further advantage of the disclosed pumping system is that the mixing of the steam with the water affects contact heat exchange. Heat is added to the jet pump nozzle outflow and ultimately to the jet pump outflow. Consequently the water flow interior of the reactor is rendered more efficient.

Yet another advantage of the disclosed system is that the requirement for a discretely separate loop for recirculation jet pump drive is eliminated. Consequently, associated problems relating to construction and maintenance of such loops are likewise eliminated. For example, the hazard of impurities lodging in such piping admitting radioactivity to maintenance personnel is avoided. Simply stated, required exterior coolant recirculation piping loops from the reactor vessel are reduced or eliminated all together.

BRIEF DESCRIPTION OF THE DRAWINGS

Other objects, features and advantages of this inveniton will become more apparent after referring to the following specification and attached drawings in which:

Referring to FIG. 1, a typical prior art jet pump is illustrated. The jet pump includes an inlet I, a mixing section M and a conical diffuser D. Diffuser D terminates in a tail pipe T. A jet J drives the pump. Typically water W is supplied to the jet J at a pressure. This pressure is typically the ambient pressure of the nuclear reactor (for example, 1020 psi), plus the additional head necessary to drive the jet pump. For example, total dynamic heads in the range of 625 feet are utilized in addition to ambient reactor pressure. A nozzle N in jet J serves the function of converting available static head in the water W to dynamic head. This dynamic head manifests itself in the high velocity of the water W being discharged from the nozzle.

As is well known, surrounding water $W_s$ is entrained. It is entrained into the inlet I and the mixing section M.

Within the mixing section M momentum transfer occurs. That is to say, the high velocity, low volume water admitted from jet J mixes with the low velocity water $W_s$. Such mixing is usually complete at the end of the mixing section M.

Typically the water at the end of the mixing section M has a flat velocity profile as indicated by the arrows 14. The function of the diffuser D is to reduce the velocity and increase outlet pressure. Accordingly, diffuser D conically expands. After the conical expansion, a tail pipe T may be utilized for discharge.

Figure 1:
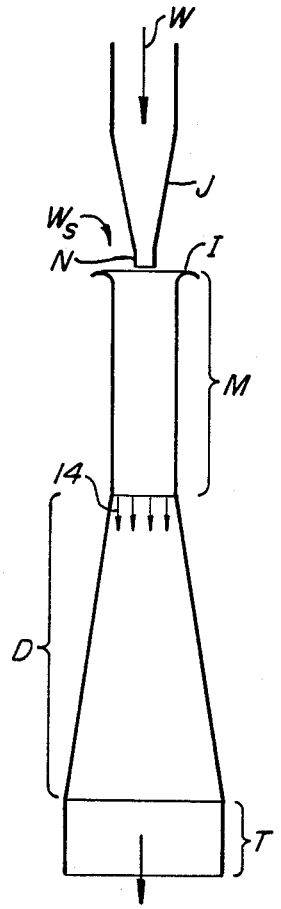
FIG. 1. PRIOR ART
FIG. 1 is a simplified schematic of a prior art jet pump.
Figure 2:
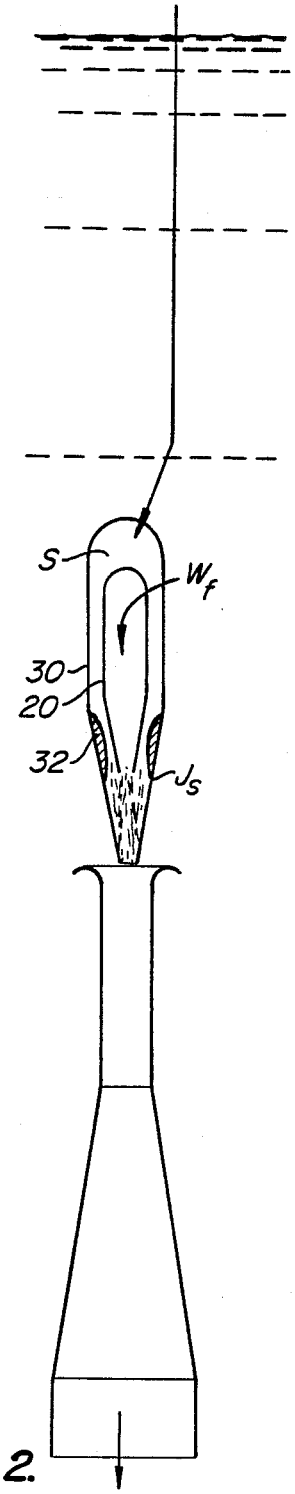
FIG. 2 is a schematic of the jet pump of this invention, the jet pump here including a nozzle mixing section for accelerating feedwater discharge with condensing steam.

Having set forth in a simplified format, the invention herein can now be summarized with respect to FIG. 2. Thereafter, and with respect to FIG. 3, the principles involved in the steam acceleration of the discharged water stream can be fully explained.

Referring to FIG. 2, feedwater $W_f$ at 340° F. is introduced interior of a water nozzle 20. At the same time, saturated steam at 545° F. is introduced interior of a steam nozzle 30. Steam nozzle 30 is provided with a converging/diverging surrounding annular discharge to nozzle 20. Fluid feedwater $W_f$ issuing from nozzle 20 is joined by steam S issuing from steam nozzle 30 through converging/diverging, concentric nozzle 32. An explanation of how the velocity is added to the steam flow may best be seen by referring to FIG. 3.

Figure 3:
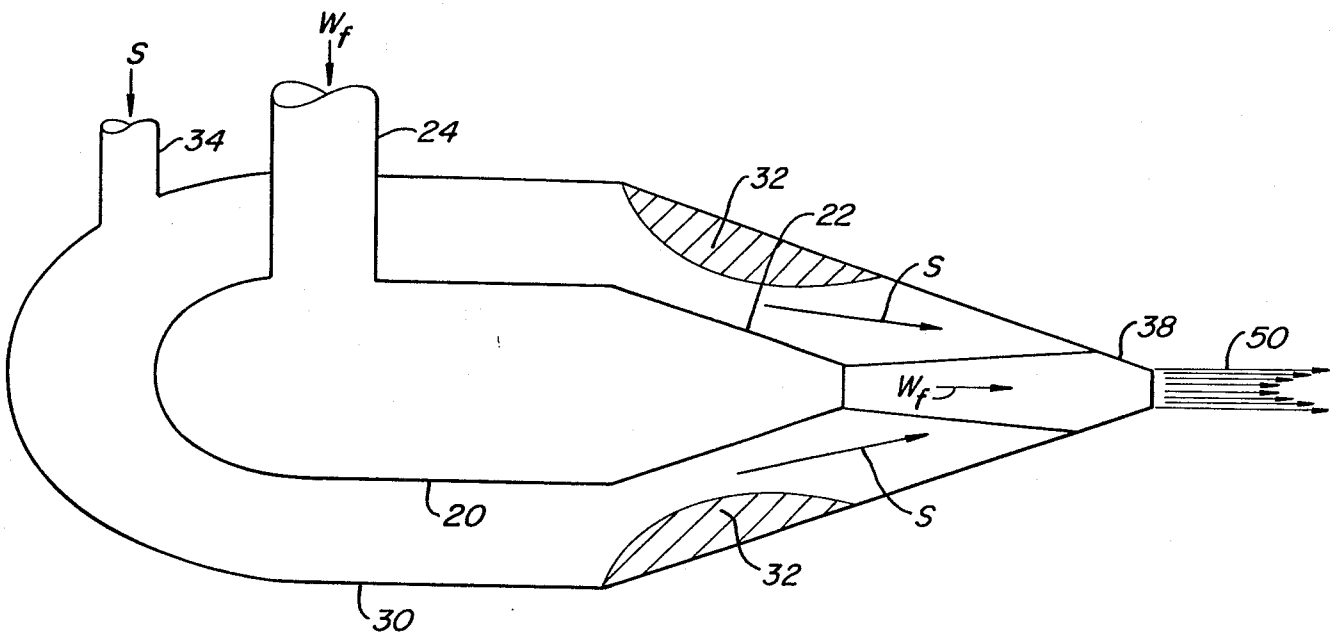
FIG. 3 is an enlarged cross-section of the chamber representing the nozzle mixing section of FIG. 2 illustrating its discharge velocity profile.
Figure 4:
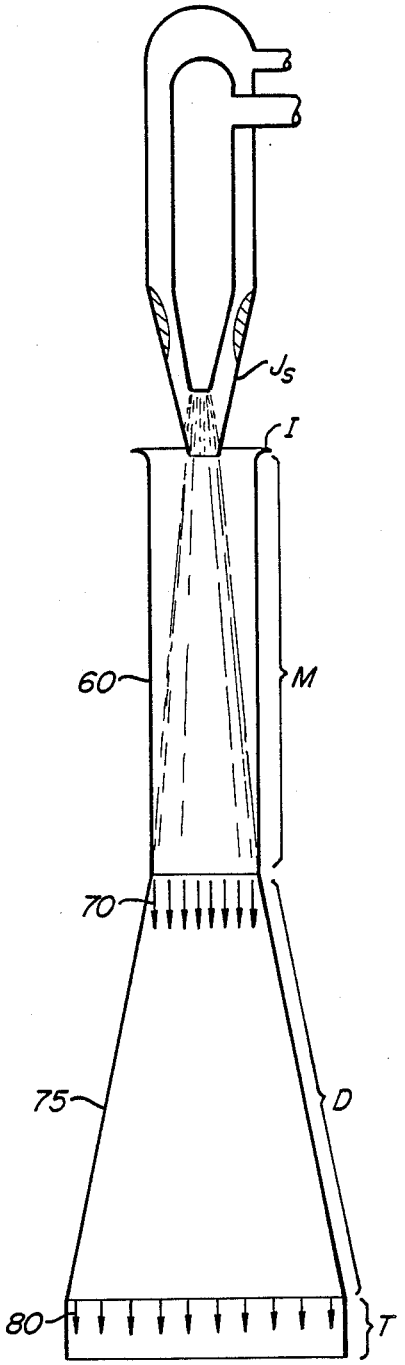
FIG. 4 illustrates the nozzles mixing section of FIG. 3 addressed to the inlet of a conventional jet pump with illustrated momentum transfer across the pump mixer and conversion of pump mixer discharge velocity to pressure head through a diffuser with discharge of the pump at a tail section.

Referring to FIG. 3, feedwater $W_f$ inflows at pipe 24 into a chamber 20. Chamber 20 is configured with a water nozzle 22 at the end thereof. Nozzle 22 discharged axially of the jet pump. See FIG. 2. At the same time, saturated steam at 545° F. and 1020 psi is introduced through pipe 34 to a steam chamber 30. Steam chamber 30 discharges at a converging/diverging nozzle 32. This converging/diverging nozzle is concentric around water nozzle 22. Thus, steam S discharging from the converging/diverging nozzle passes in the same direction as feedwater $W_f$ in slightly converging path.

It should be understood that the steam is accelerated to a very high velocity. As is well known, the steam in passing through the converging/diverging nozzles has its pressure (1,020 psi) reduced nearly to the saturation pressure of the exhaust of the water $W_f$ from the nozzle. Assuming that feedwater is discharged at a temperature of 340° F., a pressure in the range of 120 psi will be realized at the discharge of the converging/diverging nozzle 32.

Acceleration of the steam through the converging-/diverging nozzle will cause the steam to reach speeds in the range of 2,700 to 3,000 ft./sec. Steam flow will be supersonic, and will be moisture-bearing—that is, containing moisture particles. (Moisture-bearing steam is commonly termed "wet steam".)

The water jet emerging from water nozzle 20 will likewise have the same static pressure value as does the steam leaving converging/diverging nozzle 32, that is, about 120 psi. The dynamic head representing the pressure reduction between feedwater supply pressure at introduction to water nozzle 20 (viz. 1250 psi) and discharge from water nozzle 20 (viz., 120 psi) is about 2900 feet. This corresponds to a bulk average discharge velocity from water nozzle 20 of about 425 ft./sec.

When the wet steam S condenses to the stream of passing feedwater $W_f$, the high momentum of the steam molecules and moisture particles will be transferred to the water jet. Such transfer is produced by a shear force acting at the interface between the water jet and the wet steam flow. This shear force will accelerate the jet as indicated by velocity vectors 50 at the discharge of the nozzle 38. Nozzle 38 has, typically, for the specific application here described, an exhaust flow area of 85%, approximately, of the exhaust flow area of water nozzle 20. Typically, the bulk average velocity of the fluid stream issuing from the discharge end of the nozzle mixing section will be 525 ft./sec.

Remembering that the discharge velocity profile 50 of the stream $W_f$ mixed with the steam had a higher velocity gradient at the edges than at the center, it will be seen that fluid velocity ultimately developed in the driven flow $W_s$ at the sidewalls 60 near the exit of the mixing section M will have a higher velocity.

This mixing-section M sidewalls region higher velocity is known, from testing done by General Electric, to lead to important performance increases in the jet pump diffuser D. This performance improvement is the result of the fluid streamlines adjacent the diffuser sidewalls 75 being enabled over a long path length downstream into the diffuser, to avoid development of the condition known as "flow separation". (Flow separation develops when the streamlines adjacent a wall and flowing against an adverse pressure gradient are slowed to the point they can no longer remain attached to the wall. At this point, the streamlines will turn away from the wall, and a (momentary or possibly permanent eddy will form downstream of the point of flow separation.) From the point of flow separation onward, the flow in the diffuser is no longer that of a gradual velocity-reducing flow-field. Flow losses develop, because energy is removed from the main flow to drive the eddy, and because the main flow velocity leaving the diffuser exit will be higher, causing higher exit velocity losses resulting from failure to convert dynamic head to static pressure.

Simply stated, by having a discharge the jet apparatus $J_s$ with a high velocity profile on the exterior, a more favorable velocity profile 70 is established at the exit of the mixer. Accordingly, an improved performance is produced by diffuser D.

It will be realized that the introduction of steam S into the feedwater $W_f$ produces useful work on feedwater $W_f$. It also produces contact heat exchange, that is, virtually total conservation of all the thermal energy initially present in stream S. This contact heat exchange raises the temperature of the fluid discharge from the nozzle $J_s$. At same time, the overall temperature of the water passing out of the jet pump is also raised. This combination of useful work together with virtually total thermal energy conservation produces well known thermal efficiencies in a steam power plant, such as that boiling water steam power plant schematically illustrated in FIG. 5.

Figure 5:
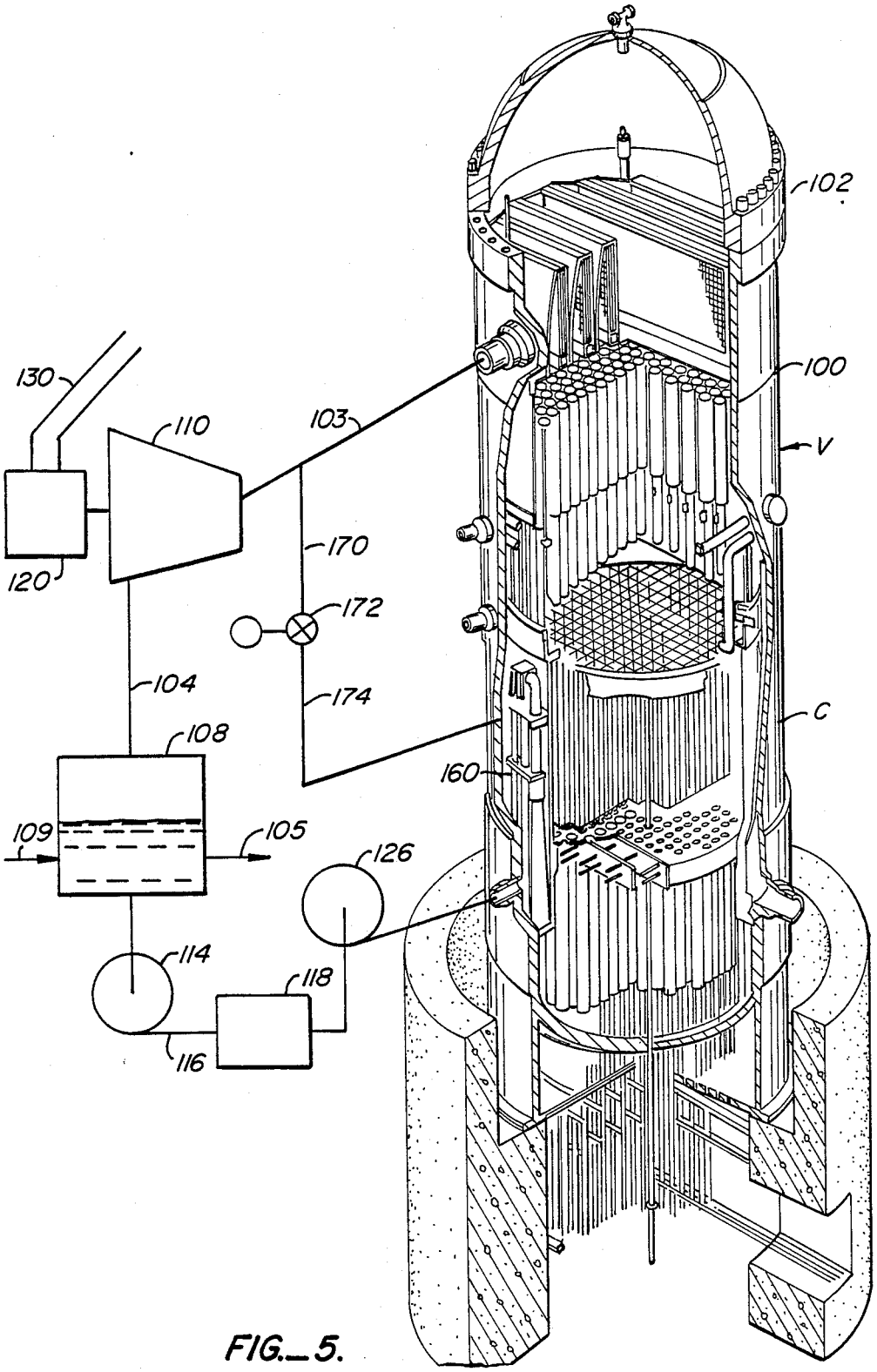
FIG. 5 is a schematic of a nuclear reactor illustrating a possible combination of the steam-assisted jet pump of this invention with a reactor.

Referring to FIG. 5, a conventional FWDJP boiling water reactor is illustrated. A reactor vessel contains a core C. Core C heats upwardly flowing coolant which thereafter passes through steam separators 100. Separated wet steam thereafter passed through steam dryer 102. The resulting effluent—dry, saturated steam—passes out a line 103 where it drives a turbine 110. Turbine 110 drives a generator 120 which in turn puts out power on lines 130.

Steam exhausted through turbine 110 passes out line 104 to a condenser 108. Coolant schematically illustrated by arrows 109 condenses discharged steam interior of condenser 108 to a pool of condensate typically residing at approximately 2 psi absolute interior of the condenser. A condensate pump 114 takes suction upon the condensate and discharges at a line 116 to a condensate preheater 118. Condensate preheater discharges to a feedwater pump 126. Feedwater pump 126 provides the balance of pressure head required to inject condensate—now termed feedwater—into the reactor, plus the additional dynamic head necessary to power the jet pump 160.

In the invention herein disclosed, a bypass line 170 diverts dry steam from line 103 as it passes to turbine 110. Steam in line 170 is typically throttled at a steam valve 172 and introduced at a line 174 to the jet pump steam chamber 30 (see FIG. 3).

It will be understood that the configuration of FIG. 5 is preferred. That is to say steam line 170, throttle valve 172 and inlet steam line 174 are all configured exterior of the reactor vessel. It can be understood, however, that a configuration such as that shown in FIG. 2 could as well be utilized. For example, wet steam discharged from steam separators 100, or alternatively, dry steam discharged from steam dryer 102 could be ducted directly in a line interior of the reactor to steam chamber 30.

Figure 6A:
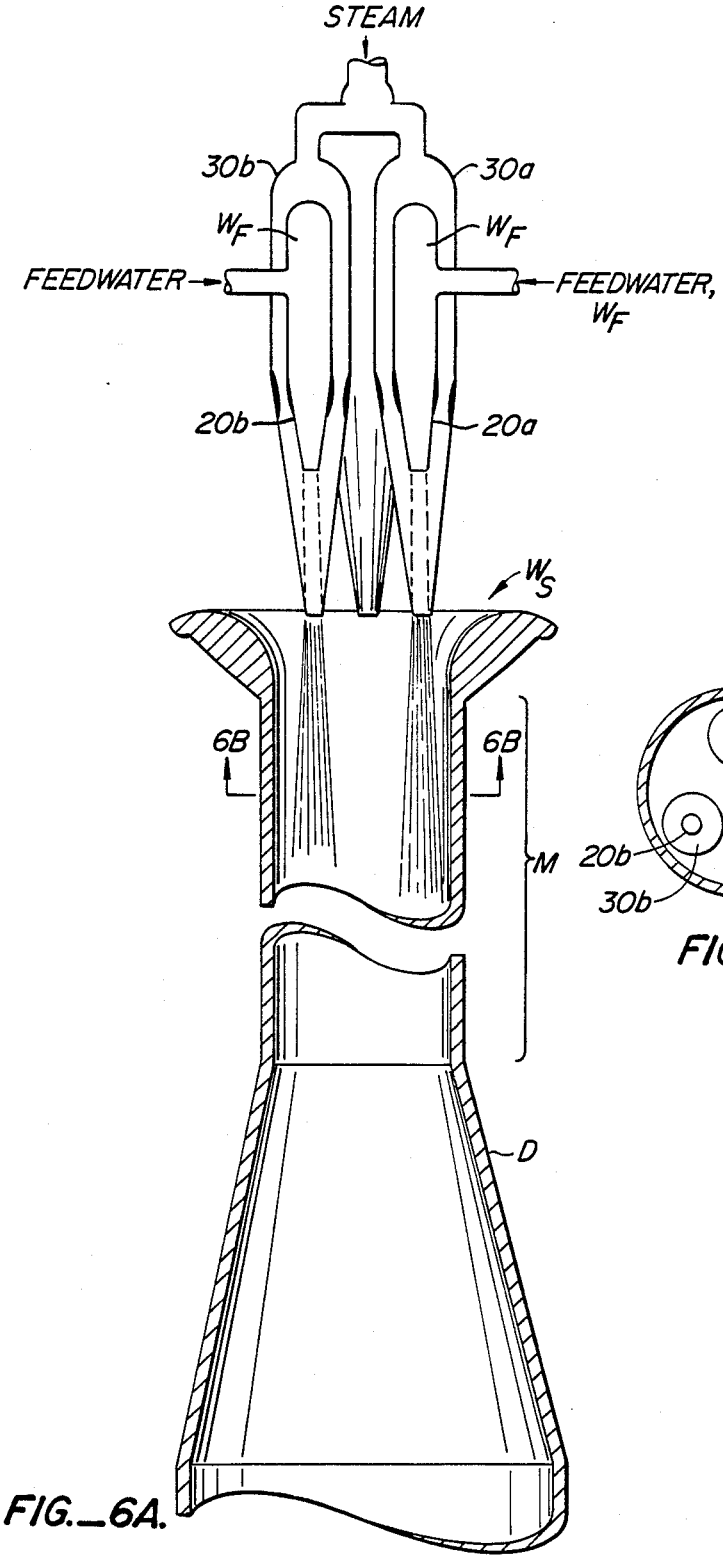
FIG. 6A is a side elevation section of a steam-assisted jet pump in accordance with this invention having multiple nozzles.
Figure 6B:
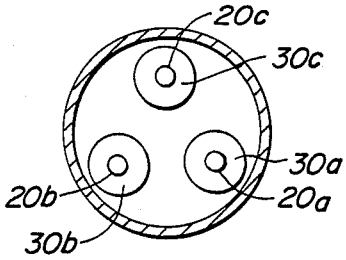
FIG. 6B is a section along lines 6B-6B of FIG. 6A showing with particularity the construction of the steam and water nozzles assemblies.

Referring to FIGS. 6A and 6B, the construction of a steam-assisted jet pump with multiple nozzles can be simply illustrated. Three steam water nozzles assemblies are shown powering the steam-assisted jet pump. Specifically feedwater $W_f$ is passed out water nozzles 20*a*, 20*b*, and 20*c*. Similarly, jets, of steam peripheral to the water jets are likewise shown at 30*a*, 30*b*, and 30*c*. Otherwise, the resultant operation is analogous.

It will also be understood that alternative applications for boiling nuclear power reactor coolant recirculation exist. The beneficial action of the invention (to supplant, increase, or simply augment the capability of a conventional of FWDJP jet pump-based coolant recirculation system) is gained without the steam expansion in steam nozzle 32 undergoing the pressure expansion so extreme as to produce supersonic velocities downsteam of steam nozzle 32. It will also be understood that steam nozzle 32 under such applications may not exclusively possess a converging-diverging flow passage area characteristic, but instead may be optimized for the particular application at hand.

It will also be understood that the invention is not necessarily limited to applications involving a single jet pump nozzle 38. (See FIG. 6A). It will also be understood that the invention has potentially significant application to securing forced circulation in the secondary side (steam plant side) of the steam generators of such nuclear power reactor types as dual cycle BWRs, pressurized light water reactors, heavy water rectors of the CANDU type, liquid metal reactors, and certain gas-cooled reactors. It will also be understood that the invention has potentially significant application to recirculating water in many types of fossil fueled boilers.

What is claimed is:

1. In a nuclear reactor having forced circulation jet pumps for causing pumped flow of reactor water coolant through the core of said reactor in forced circulation, said reactor further including a steam outlet for providing steam to a power source and a feedwater inlet communicated from a feedwater system for replacing said outflowing steam with a corresponding supply of water coolant for generation into steam, the improvement to said jet pumps comprising: a jet pump having an inlet, a mixer section and a diffuser section said inlet and said diffuser communicated to water coolant to be force circulated within said reactor; a nozzle communicated to said mixer for entraining water coolant into said inlet and transferring momentum to said water coolant in said mixer for discharge of pumped water coolant in forced circulation through the core of said reactor, said nozzle including a first water jet communicated from the feedwater inlet of said nuclear reactor for receiving said feedwater at a temperature below the saturation temperature of said reactor and discharging water in an accelerated fluid stream;

pump means communicated to said feedwater inlet for intake from said feedwater system and discharge through said nozzle for introducing feedwater into said reactor;

said nozzle further including a second stream jet communicated from the saturated steam outlet of said reactor, said feedwater jet and said steam jet discharging their respective flows in the direction of the nozzle of said jet pump;

a mixing chamber configured to receive said steam jet and said water jet, said mixing chamber communicated to water interior of said nuclear reactor for forced circulation within said nuclear reactor, said mixing chamber having a sufficient length dimension to allow condensation of said steam jet on said water jet whereby the momentum of said steam is transferred to said water interior of said mixing chamber of said jet pump to accelerate said water;

said jet pump further including a discharge section for discharging said water and steam forced circulation interior of said reactor.

2. A process of forced circulation of water within a boiling water reactor, said reactor having a core, a steam outlet, a turbine, a condenser for condensing steam from said turbine into water, and a feedwater system for taking water from said condenser and introducing said water back into said reactor; said process comprising the steps of:

providing a forced circulation loop for water flow interior of said reactor for pumping water in a loop through said reactor core;

providing at least one jet pump body including an inlet, a mixer selection and a diffuser section;

placing said jet pump body in the water of said reactor to be circulated through said core with said inlet and diffuser communicated to water to be force circulated within said reactor;

providing a jet from said water of said feedwater system for circulating water through said jet pump body, said jet directed to said inlet and thereafter passing through said mixer and diffuser sections of said jet pump body, said provided jet including a water jet communicated from said feedwater system having a temperature less than the saturation temperature of steam within said reactor;

providing a steam jet from the steam produced by said reactor at the saturation temperature of said reactor;

aligning said steam jet and said water jet to output fluid through the nozzle of said jet pump into the mixer section of said provided jet pump;

providing a nozzle mixing chamber communicated to said steam jet to permit said steam jet to condense to said water jet to thereby transfer momentum to said water jet;

and discharging the flow from said jet to the mixer section of said jet pump body in the direction from said inlet to said diffuser section whereby a water jet of water interior of said reactor of increased momentum from the discharge section of said nozzle mixing chamber drives said jet pump to force circulate said water in said reactor.

3. In a steam generator having forced circulation jet pumps for causing pump flow of coolant through the steam generator in a pattern of forced circulation, said steam generator further including a steam outlet for providing steam to a power source and a feedwater inlet communicated to a feedwater system for replacing said outflowing steam to the corresponding supply of water for generation into steam, the improvement to said jet pumps comprising;

a jet pump having an inlet, a mixer section, and a diffuser section;

said inlet and diffuser section communicated to water interior of said steam generator for forced circulation;

a nozzle communicated to said mixer section for entraining water from said inlet and transferring momentum to water in said mixer for discharge of pumped coolant in said loop through said diffuser section, said nozzle including a first water jet communicated from the feedwater system of said steam generator for receiving said feedwater at a temperature below the saturation temperature of said steam generator and discharging water in an accelerated fluid stream;

pump means for intake from said feedwater system and discharge through said feedwater inlet to said nozzle for introducing feedwater back into said generator;

said nozzle further including a second steam jet communicated from the saturated steam outlet of said steam generator, said feedwater jet and said steam jet discharging their respective flows in the direction of the nozzle of said jet pump;

a mixing chamber configured to receive said steam jet, said water jet, and said entrained water from said steam generator, said mixing chamber having a sufficient length and dimension to allow condensation of said steam jet on said water jet whereby the momentum of said steam is transferred to said water interior of said steam generator to accelerate said water;

said jet pump further including a discharge section for discharging said water and condensed steam into forced circulation interior of said steam generator.

4. The invention of claim 3 and wherein said steam generator constitutes a nuclear reactor.

* * * * *